US005766318A

United States Patent [19]

Loreth et al.

[11] Patent Number: 5,766,318

[45] Date of Patent: Jun. 16, 1998

[54] PRECIPITATOR FOR AN ELECTROSTATIC FILTER

[75] Inventors: Andrzej Loreth, Åkersberga; Vilmos Török, Lidingö, both of Sweden

[73] Assignee: TL-Vent Aktiebolag, Lidingo, Sweden

[21] Appl. No.: 648,034

[22] PCT Filed: Nov. 24, 1994

[86] PCT No.: PCT/SE94/01131

§ 371 Date: Aug. 12, 1996

§ 102(e) Date: Aug. 12, 1996

[87] PCT Pub. No.: WO95/14534

PCT Pub. Date: Jun. 1, 1995

[30] Foreign Application Priority Data

Nov. 24, 1993 [SE] Sweden ..... 9303894

[51] Int. Cl.[6] ..... B03C 3/60

[52] U.S. Cl. ..... 96/69; 96/98

[58] Field of Search ..... 96/69, 66, 98–100, 96/68, 72, 73, 65, 71; 55/524, 360; 95/59

[56] References Cited

U.S. PATENT DOCUMENTS

| | | | |
|---|---|---|---|
| 2,958,393 | 11/1960 | Lueder | 96/99 |
| 4,354,861 | 10/1982 | Kalt | 96/69 |
| 5,466,279 | 11/1995 | Hattori et al. | 96/98 X |

FOREIGN PATENT DOCUMENTS

| | | | |
|---|---|---|---|
| 314811 | 5/1989 | European Pat. Off. . | |
| A1 0 314 811 | 5/1989 | European Pat. Off. . | |
| 4139474 | 6/1992 | Germany . | |
| 4139474 A1 | 6/1992 | Germany . | |
| 3-174263 | 7/1991 | Japan | 96/98 |
| 5-161858 | 6/1993 | Japan | 96/98 |
| 93/16807 | 9/1993 | WIPO . | |
| WO 93/16807 | 9/1993 | WIPO . | |

*Primary Examiner*—Richard L. Chiesa

*Attorney, Agent, or Firm*—Pearne, Gordon, McCoy & Granger LLP

[57] ABSTRACT

In an electrostatic precipitator for an electrostatic filter at least one group (11 and/or 12) of electrode or plate elements of like polarity are made of or coated with a semiconducting or dissipative material, and the electrode elements of at least one group (12) include, or are associated with, a screen (16) of an insulating material at the edge thereof which is directed against the stream (A) of air through the precipitator.

1 Claim, 1 Drawing Sheet

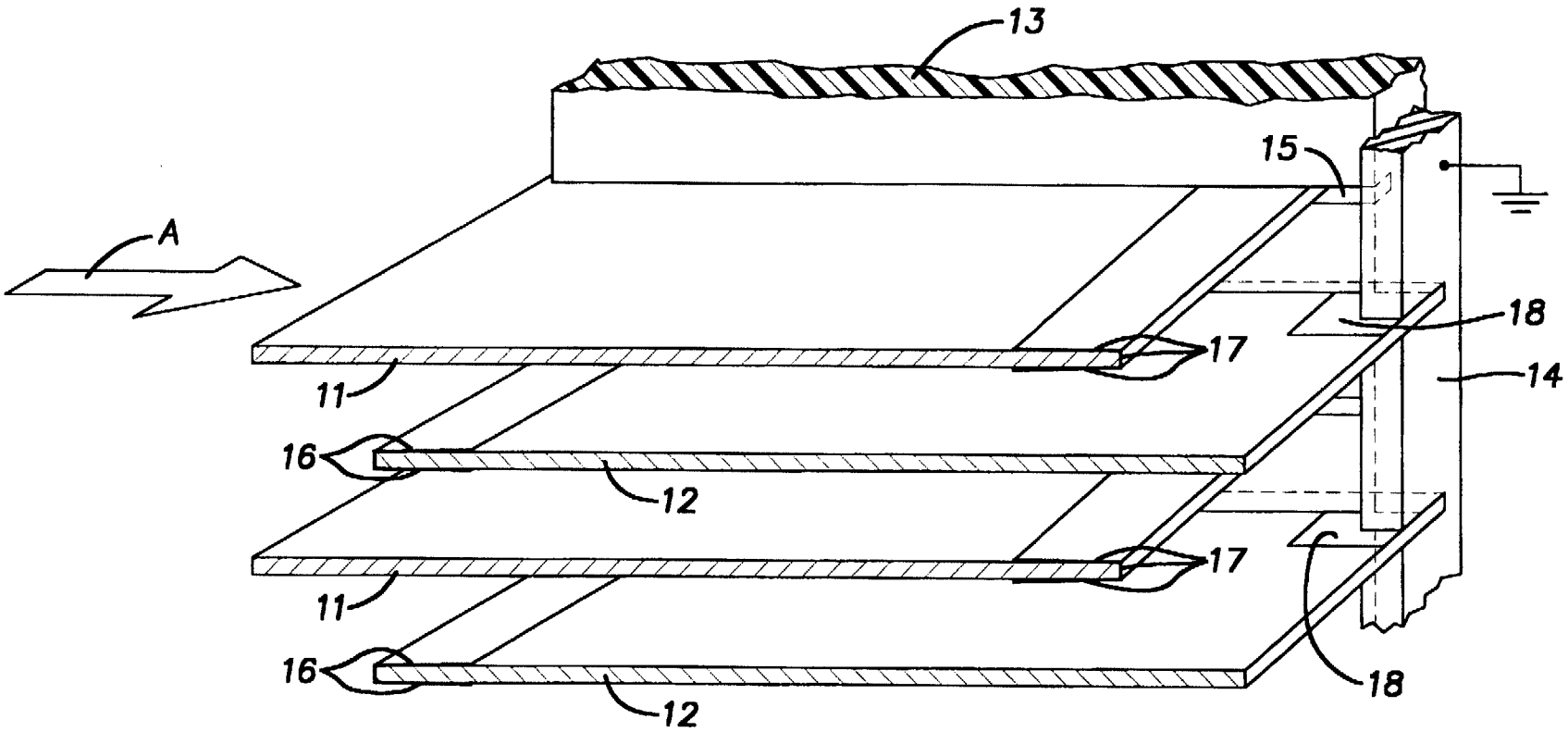
13
15
18
14
18
17
17
12
12
11
11
16
16
A

PRECIPITATOR FOR AN ELECTROSTATIC FILTER

BACKGROUND OF THE INVENTION

This invention relates to a precipitator for a two-stage electrostatic filter.

WO 93/16807 discloses a two-stage electrostatic filter which comprises an ionizer and a capacitor or electrostatic precipitator (collector) positioned downstream of the ionizer. Advantageously, the electrode elements of the precipitator, which in the illustrated embodiment are flat plates but may have different shapes in other embodiments, are made of a material that may be designated as highly resistive or antistatic (so-called dissipative material). With such a material a substantial improvement can be achieved, because the voltage that can be produced between adjacent electrode elements is self-regulating and can reach higher values than in the customary electrostatic filters having electrode elements made of a material of low resistivity, such as aluminium, and having a galvanic connection to the voltage source.

In the embodiment disclosed in the above-mentioned publication, the plates preferably are charged by the ion current from the corona electrode of the ionizer, and the voltage between them is stabilized because the electrode elements have field-concentrating formations, which may take the shape of, for example, sharp edges or other pointed parts of the electrode elements.

SUMMARY OF THE INVENTION

The present invention advantageously can be embodied in two-stage electrostatic filters of the kind disclosed in the above-mentioned publication, but it is not limited to use in filters of that kind. For example, the charged particles by means of which the precipitation of dust on the electrode elements is brought about need not necessarily be produced in an ionizer of the type disclosed, but may be produced and carried to and through the precipitator in any suitable manner. Moreover, it is not necessary that the electrode elements be charged by the air ions produced in the ionizer. Instead, the required voltage between adjacent electrode elements may be maintained by a connection of the electrode elements to a high-voltage source, preferably a very highly resistive connection.

An object of the invention is to provide a high, and yet stable, voltage, i.e. a high threshold voltage, with narrow air gaps between adjacent electrode or plate elements of the precipitator, so that the precipitator may be used in applications in which the precipitator has to meet high stringent demands in respect of precipitation capability.

According to the invention, this object is attained by using a highly resistive, antistatic or almost antistatic (dissipative) material of, or coating on, the electrode elements of the precipitator and at the same time avoiding field concentrations, especially at those edges of the electrode elements which are at the upstream end of the electrode elements and, consequently, confront the stream of air that carries the charged particles to be precipitated on the electrode elements.

According to the invention, this can be accomplished by providing the electrode element edges in question with a screen made of a non-conducting, insulating material. This screen need not necessarily be applied to the edges, meaning that it need not be physically connected with the edges, but may be slightly spaced from them; it is sufficient that the screen is constructed and positioned such that it electrostatically screens the edges from the electric field.

The screening may be provided by making the electrode elements from an insulating material and coating them with a semiconducting or antistatic material such that their edges are left insulated (uncoated) so that only the electrode element surface inwardly (downstream) of the edges is semiconducting or antistatic.

The same effect may be achieved if the electrode elements are made from a semiconducting or antistatic material and the edges thereof are coated with an insulating, non-conducting material.

Advantageously, the first-mentioned way of providing the screening may be used in cases in which a cellulose material, such as paper or cardboard, is used for the electrode elements and the precipitator is to operate in a dry and warm environment. An example of such cases is precipitators of electrostatic filters for vacuum cleaners. In such cases, the excellent natural semiconducting or antistatic properties of the cellulose material may be lost after some time of operation because of the heating of the air that occurs in the vacuum cleaner, so that the material becomes comparable to an insulating material.

In the preferred embodiment of the present invention, the electrode elements may advantageously be charged by air ions supplied from an ion current generated by a corona electrode positioned upstream of the precipitator in accordance with the disclosure of the above-mentioned publication.

To this end, the electrode elements to be charged in this manner should project in the upstream direction beyond the electrode elements of a different polarity—preferably, the last-mentioned electrode elements are grounded and for the sake of simplicity will be referred to hereinafter as the grounded electrode elements whereas the first-mentioned electrode elements will be referred to as the charged electrode elements—and they should also be screened in the above-explained manner so that field-concentrating formations at the edges are screened. If not screened, these formations would limit the voltage because of discharges to the grounded electrode elements.

Similar considerations apply to the trailing or downstream end of the grounded electrode elements. In the preferred embodiment the grounded electrode elements extend in the downstream direction beyond the charged electrode elements. The trailing edge of the grounded electrode elements, which thus protrudes in the downstream direction, may advantageously also be antistatic or semiconducting so that it can readily be connected to ground.

In the preferred embodiment of the present invention, the electrode elements are insulated from one another. The insulation may be arranged such that it covers the electrode element edges extending in the direction of air flow so that these edges are also screened from the electrical field.

As is apparent from this description, the invention comprises screening of the field-concentrating formations which in the electrostatic filter according to the above-mentioned publication exist at the electrode element edges and have an undesired effect by being positioned opposite and therefore, so to speak, "seeing" adjacent electrode elements of a different potential. The invention thereby provides a precipitator in which the attainable voltage between adjacent electrode elements is limited primarily only by the electrical properties of the dust which has precipitated on the electrode elements and which itself can be regarded as field-concentrating formations located on the electrode element surface inwardly of the electrode element edges. In this manner, self-stabilisation of the voltage between the electrode elements is achieved at a higher voltage level than can be achieved according to the prior art.

BRIEF DESCRIPTION OF THE DRAWING

The single figure in the accompanying drawing is a fragmentary perspective view of an exemplary embodiment of a precipitator according to the invention.

DESCRIPTION OF THE PREFERRED EMBODIMENT

This precipitator may be a part of the two-stage electrostatic filter disclosed in the above-mentioned publication, for example, but it may also be incorporated in other electrostatic filters.

The stream of air which carries charged particles to be precipitated on the electrode elements of the precipitator is indicated by an arrow A. Only a portion of the precipitator is shown, namely two pairs of electrode elements 11 and 12, respectively, in the form of flat plates, a lateral wall 13 of insulating material, which supports the electrode member plates at one edge thereof, i.e. a lateral edge extending in the direction of flow of the air stream A passing through the air passage formed by the precipitator and subdivided into a large number of subpassages by the plates, and finally a contact strip or bar 14 of conductive rubber or plastic material through which the plates 12 are connected to a reference potential, preferably ground, at their downstream edges.

The lateral or longitudinally extending edges of the plates 11 and 12 are received in groves 15 formed in the opposing sides of the side walls 13 which are made of an insulating material, such as expanded plastic.

In the illustrated embodiment the precipitator plates 11 are maintained at the required potential by being charged by the air ions which are transported in the same direction as the air stream A and surrender their charges to the plates. However, it is within the scope of the invention to maintain the plates 11 at the required potential by means of a high-voltage source. If a high-voltage source is used, it preferably has a high-resistance connection with the plates and is adapted to limit the charging current to very low values.

As shown in the drawing, because of the manner of charging of the plates 11 by air ions, these plates extend a short distance beyond the plates 12 in the upstream direction, i.e. against the direction of flow of the air stream A, so that the air stream first encounters the leading or upstream edge of the plates 11. At the downstream end of the air passage through the precipitator, the grounded plates 12 extend beyond the plates 11 in the downstream direction so that they are readily accessible for connection to ground through the contact strip 14.

Plates 11 and 12 are made of a semiconducting or dissipative material, preferably a fibrous cellulose material, such as cardboard or paper, and screened in the above-described manner.

Thus, at their upstream or leading edge, plates 12 have a coating 16 of an insulating material. This coating may be applied by painting or in some other suitable manner, such as by attachment of an edge strip or edge bar.

Plates 11 are provided with a corresponding screening 17 at their downstream or trailing edge. These plates are also screened at their longitudinal or lateral edges because these edges are received in and contacted by the insulating material of the walls 13. These edges thus do not require a separate coating of insulating material.

Thus, in accordance with the invention, those plate edges which, so to speak, "see" the upper side or the under-side of adjacent plates are screened such that field-concentrating formations at these edges cannot cause discharges to adjacent plates.

At their downstream edges, the grounded plates 12 are provided with a conductive coating 18 forming an electrical connection between the body of the plates and the contact strip 14.

We claim:

1. An electrostatic precipitator for a two-stage electrostatic filter, comprising first and second groups of electrode elements (11,12) which are positioned side by side and spaced apart to define flow passages for air from which particles are to be precipitated, the electrode elements (11) of the first group alternating with the electrode elements (12) of the second group and being adapted to be at a potential different from that of the electrode elements of the second group, wherein the electrode elements of the second group have upstream edges positioned downstream with respect to upstream edges of the electrode elements of the first group and at least the electrode elements (11 and/or 12) of one group are made of, or coated with, a semiconducting material and wherein at least the electrode elements (12) of the second group comprise, or are provided with, a screen (16) of an insulating material at least at the upstream edge thereof.

* * * * *